US006908344B1

(12) United States Patent
Ahmed et al.

(10) Patent No.: US 6,908,344 B1
(45) Date of Patent: Jun. 21, 2005

(54) SYSTEM AND METHOD FOR PREVENTING CONNECTOR DAMAGE

(75) Inventors: Ali U. Ahmed, Round Rock, TX (US); Raymond D. Heistand II, Round Rock, TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 10/727,815

(22) Filed: Dec. 4, 2003

(51) Int. Cl.[7] ..... H01R 13/627
(52) U.S. Cl. ..... 439/677; 439/362
(58) Field of Search ..... 439/677, 362

(56) References Cited

U.S. PATENT DOCUMENTS 4,996,887 A * 3/1991 Voll et al. ..... 439/78
5,298,683 A * 3/1994 Taylor ..... 174/152 GM
5,655,914 A * 8/1997 McCartin et al. ..... 439/78
6,039,581 A * 3/2000 DiMarco ..... 439/74
6,062,907 A 5/2000 Tan et al. ..... 439/610
6,126,451 A 10/2000 Zandy et al. ..... 439/61
6,296,500 B1 10/2001 Liao ..... 439/188
6,435,897 B1 8/2002 Paul et al. ..... 439/374
6,454,592 B2 9/2002 Takagi ..... 439/378
6,460,104 B1 10/2002 Zandy et al. ..... 710/129
6,471,543 B1 * 10/2002 Balcombe et al. ..... 439/565
6,616,341 B2 9/2003 Gallup et al. ..... 385/53
6,626,699 B1 9/2003 Epe et al. ..... 439/527

* cited by examiner

*Primary Examiner*—Hae Moon Hyeon
(74) *Attorney, Agent, or Firm*—Baker Botts L.L.P.

(57) ABSTRACT

An information handling system includes a chassis body for storing information handling system components. The chassis body has one or more D-style connectors that have a trapezoidal connector body. A connector guide is installed proximate the one or more D-style connectors and facilitates the proper orientation and alignment of a mating connector during installation.

19 Claims, 3 Drawing Sheets

SYSTEM AND METHOD FOR PREVENTING CONNECTOR DAMAGE

TECHNICAL FIELD

The following disclosure relates in general to computer and electronic systems and more specifically to a system and method for preventing connector damage.

BACKGROUND

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Information handling systems typically include a number of connector components that protrude from a rear portion or side portion of an information handling system housing or chassis. Connectors allow the information handling system to connect with peripheral components, networks and other information handling systems. Pin-type connectors allow the connection of multiple pins to transfer information along multiple channels. Different types of connectors often have standardized shapes. Some connectors are circular in shape other connectors such as D-style connectors are generally trapezoidal in shape.

During the installation of D-style connectors, the connector pins and connectors themselves can become damaged if the mating connector is installed or attempted to be installed in an incorrect orientation such as an upside down orientation. Additionally damage to the connector can occur if the mating connector is misaligned or cocked with respect to the D-style connector. Damaged connectors or pins may lead to any number of different problems. Often, in order to correctly diagnose a problem related to a damaged connector or pin, a manufacturer must dispatch service personnel to a customer site. The cost of service personnel and replacement parts may impose significantly the cost to an information handling system manufacturer and may cause a user dissatisfaction and frustration until the problem is resolved.

SUMMARY

Therefore a need has arisen for a system and method for preventing cable damage caused by the incorrect installation of D-style connectors.

A further need exists for a system method for facilitating proper alignment and orientation of the installation of D-style connectors.

In accordance with teachings of the present disclosure a system method are described for providing a connector guide that facilitates the proper alignment and orientation of a connector during installation that significantly reduces problems associated with previous systems and methods of connecting connector elements to information handling systems.

In one aspect an information system is disclosed that includes a chassis body for storing information handling system components. The chassis body has one or more D-style connectors that has a trapezoidal connector body. A connector guide is installed proximate the one or more D-style connectors and facilitates the proper orientation and alignment of a mating connector during installation.

In another aspect, a connector guide for preventing information handling system connector pin damage includes a connector guide body having an opening to allow a D-style connector to extend therethrough. The connector guide body has a first end and a second end each having an attachment portion formed, the attachment portion is formed to interface with a first stud and a second stud that are located next to a D-style connector.

In another aspect, a method for preventing connector pin damage includes providing a D-style connector that is associated with an information handling system. A connector guide is then installed proximate the D-style connector to preventing an inverted mating connector from interfacing with the D-style connector.

The present disclosure includes a number of important technical advantages. One important technical advantage includes providing a connector guide proximate the D-style connector. The connector guide facilitates the correct orientation and alignment of mating connectors, thereby reducing the likelihood of cable pin damage. Further technical advantages will be apparent to those skilled in the art in the description FIGURES and claims below.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Preferred embodiments and their advantages are best understood by reference to FIGS. 1 through 6, wherein like numbers are used to indicate like and corresponding parts.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

Figure 1:
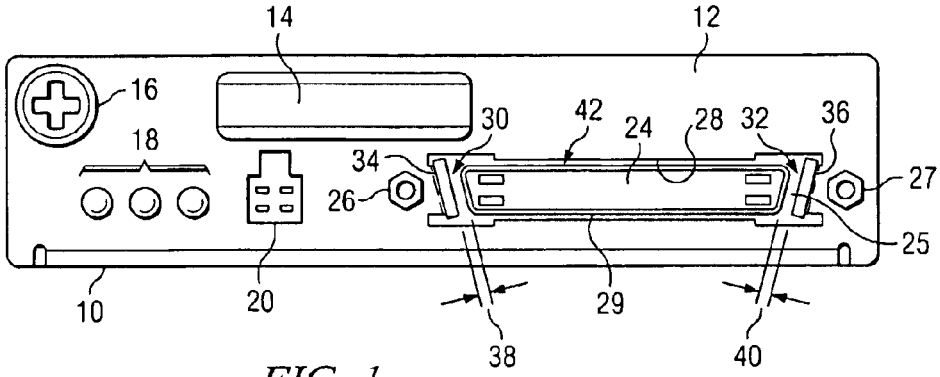
FIG. 1 is in view of an information handling system chassis body having a D-style connector and connector guide according to teachings of the present disclosure.

Now referring to FIG. 1 a view of chassis body 10 of an information handling system component is shown. Chassis body includes back plate 12 having handle 14 attached thereto and fastener 16. In the present embodiment, chassis body 10 houses an I/O Management Module used to transfer data in a storage device. In the present embodiment, chassis body 10 includes status indicators 18 and connector port 20.

Chassis body 10 may be referred to herein as a chassis, a body, a housing or an enclosure and may be any housing associated with an information handling system or an information handling system component. In alternate embodiments chassis body 10 may encompass any chassis body or housing for an information handling system or information handling system component that incorporates a D-style connector. In some alternate embodiments, chassis body 10 may be a body or housing of an internal information hauling system component. In some particular embodiments, chassis body 10 and connector 24 are associated with a SCSI card, a RAID card or an SAS card. Back plate 12 has opening 25 formed therein and D-style connector 24 extending therethrough.

D-style connector 24 has a connector body 42 with a trapezoidal shape. In the present embodiment D-style connector 24 is preferably a 68 pinned SCSI type connector. In alternate embodiments D-style connector 24 may be any connector having a D-style shape. In other alternate embodiments, D-style connector may also incorporate other connector shapes such as keboard, mouse, or USB connectors.

Opening 25 is formed and sized to allow D-style connector 24 to extend therethrough. Opening 25 includes top edge 28, bottom edge 29, first side edge 30 and second side edge 32. Additionally in the present embodiment first attachment stud 26 is disposed adjacent to a first end of D-style connector 24. A second attachment stud 27 is disposed adjacent to a second side of D-style connector 24. In the present embodiment a connector guide is formed adjacent to D-style connector 24 includes first alignment flange 34 and second alignment flange 36. First alignment flange 34 extends perpendicularly from first side edge 30 and second alignment flange 36 extends perpendicularly from second side edge 32. First alignment flange 34 and second alignment flange 36 are formed at an angle generally parallel with the angles of the sloped ends of D-style connector body 42. In the present embodiment first alignment flange 34 and second alignment flange 36 are formed from a portion of back plate 12 that has been manipulated to form opening 25.

In the present preferred embodiment first alignment flange 34 and second alignment flange 36 each have a length that is slightly longer than the length of the sloped ends of D-style connector body 42. Additionally, the height of first alignment flange 34 and second alignment flange 36 (e.g., the distance that the alignment flanges extend perpendicularly from back plate 12) is slightly greater than the height of D-style connector 24. In other words, in the present embodiment, first alignment flange 34 and second alignment flange 36 both extend from back plate 12 slightly further than D-style connector 24 extends from back plate 12. In alternate embodiments, first alignment flange 34 and second alignment flange 36.

In the present embodiment first alignment flange 34 and second flange 36 are formed proximate to D-style connector body 42 such that gaps 38 and 40 are formed between first alignment flange 34 and left side of D-style connector body 42 and between second alignment flange 36 and the right side of D-style connector body 42. Gaps 38 and 40 preferably provide sufficient clearance for the mating connector body, 62 as shown in FIG. 2.

In the present embodiment first attachment stud 26 and second attachment stud 27 both comprise hex studs that are sized to allow fasteners of a mating connector to be screwed therein, thereby securing the mating connector to D-style connector 24. In alternate embodiments any suitable fastener assembly may be used to secure a mating connector with D-style connector 24. In other alternate embodiments the present disclosure contemplates the use of D-style connectors that do not include fasteners such as first attachment stud 26 and second attachment stud 27.

Figure 2:
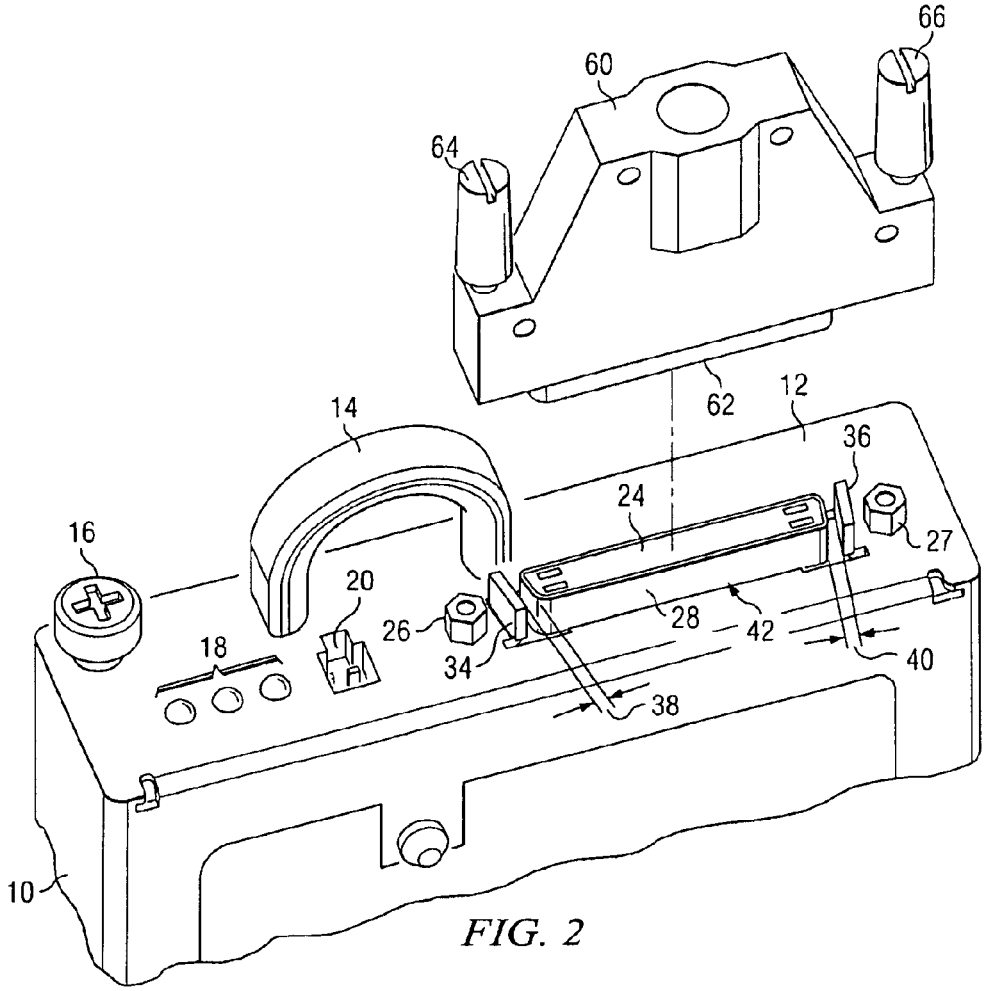
FIG. 2 is a perspective view of an information handling system chassis body having a D-style connector and connector guide according to teachings of the present disclosure.

Now referring to FIG. 2 a prospective view of chassis body 10 of FIG. 1 is shown with mating connector 60 provided for connecting with D-style connector 24. Mating connector 60 includes mating connector body 62 that houses a plurality of pins. Mating connector body 60 further includes first fastener 64 and second fastener 66. In general operation, mating connector body 62 is aligned with and depressed adjacent to D-style connector 24, allowing the pins of mating connector body 62 to connect with the mating receptacles of D-style connector 24. The first alignment flange 34 and second alignment flange 36 prevent mating connector 60 to be in the upside down orientation and also encourage mating connector body 62 be in a proper alignment with respect to D-style connector 24 to be properly connected therewith.

In operation if mating connector 60 is in an upside down orientation the edges of mating connector body 62 will encounter first alignment flange 34 and second flange 36 will prevent the improperly oriented mating connector from interfacing with D-style connector 24, thereby alerting the user to the incorrect orientation of mating connector 60. In the event that mating connector 60 is attempted to be installed in an incorrect alignment (that is improper angle) gap 38 and 40 facilitates aligning mating connector 60 at a proper angle for insertion.

Figure 3:
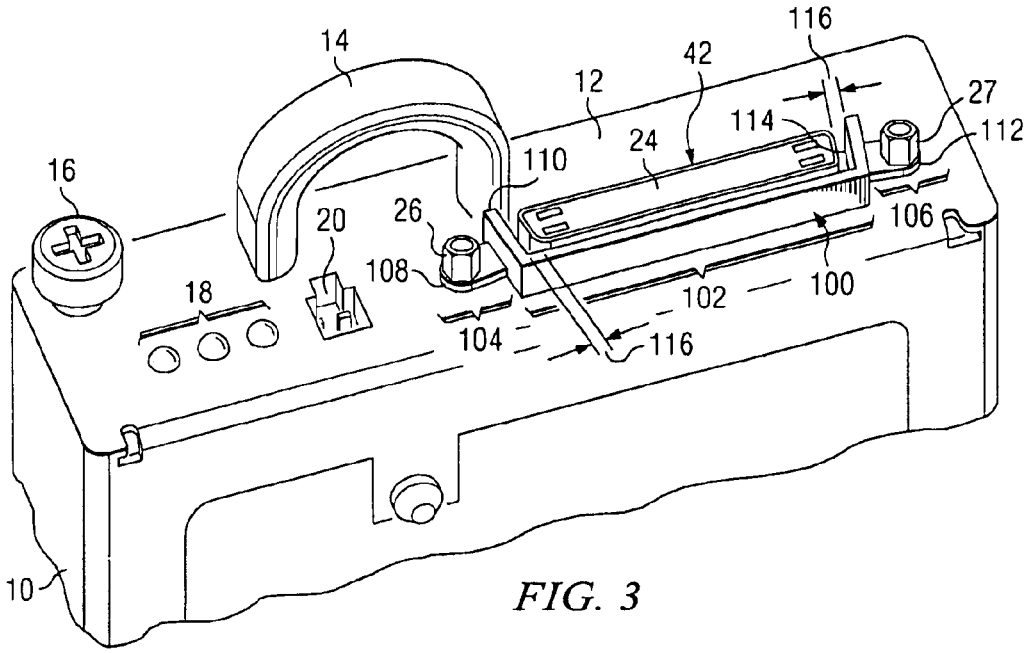
FIG. 3 is an end view of a three sided flange style connector guide disposed on an information handling system.

Now referring to FIG. 3 a perspective view of chassis body 10 with connector guide 100 is shown. As shown in FIG. 1 chassis body 10 includes back plate 12 and handle 14. Back plate 12 also has an opening formed therein that allows D-style connector 24 to extend therethrough. D-style connector 24 also includes connector body 42 having a trapezoidal shape.

The connector guide of the present embodiment comprises a flange member 100. Flange member 100 includes a three sided flange member including a longitudinal flange member 102 having a first end 104 and second end 106. The first end 104 includes first end connector tab 108 and first end flange member 110. Second end 106 includes second flange member 114 and second end connector tab 112. Longitudinal flange member 102 comprises a vertical flange with a height substantially equal to the height of connector body 42. Accordingly, longitudinal flange member 102 extends from back plate 12 approximately as far as connector body 42 extends from back plate 12. In alternate embodiments, flange member 102 may extend from back plate 12 slightly further than connector body 42.

First end 104 is formed at the left end of a longitudinal flange member 102. First end 104 includes first end flange member 110. First end flange member 110 extends from longitudinal flange member 102 at an angle generally parallel to the angle of the end of connector body 42. First end connector tab 108 extends generally perpendicular from the bottom of first end flange member 110 such first end connector member 108 may be disposed adjacent to back plate 12. Similarly, second end flange member 114 extends from the right edge of longitudinal flange member 102 at angle generally parallel with the angle of the side of connector body 42. Second end flange member 114 has a height generally equal to the height to connector body 42. Second end connector tab 112 extends generally perpendicular from the bottom edge of second end flange member 114 such that second end connector tab 112 may be disposed adjacent to back plate 12. Connector guide 100 is preferably disposed such that a generally uniform gap 116 lies between the three sides of D-style connector body 42 and the three sides of connector guide 100 (first end flange member 110, longitudinal flange member 102, and second end flange member 114). Connector guide 100 and gap 116 preferably prevents a mating connector (as shown in FIG. 2) from attempts to be installed with an incorrect orientation or at an incorrect angle. In the present embodiment attachment studs 26 and 27 hold secure connector guide 100 onto the back plate 12 by threading through the clearance holes located in flanges 108 and 112.

Figure 4:
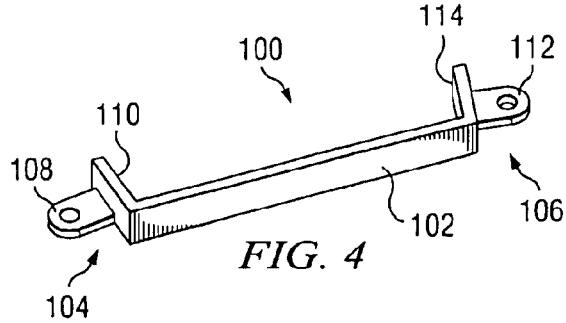
FIG. 4 is a three sided flange connector guide.

Now referring to FIG. 4, a perspective view of connector guide 100 is shown. Connector guide 100 includes longitudinal flange member 102 with first end 104 and second end 106. First end 104 as described above includes first end connector tab 108 and first end flange member 110. Second end 106 generally includes second end flange member 114 and second end connector tab 112.

Figure 5:
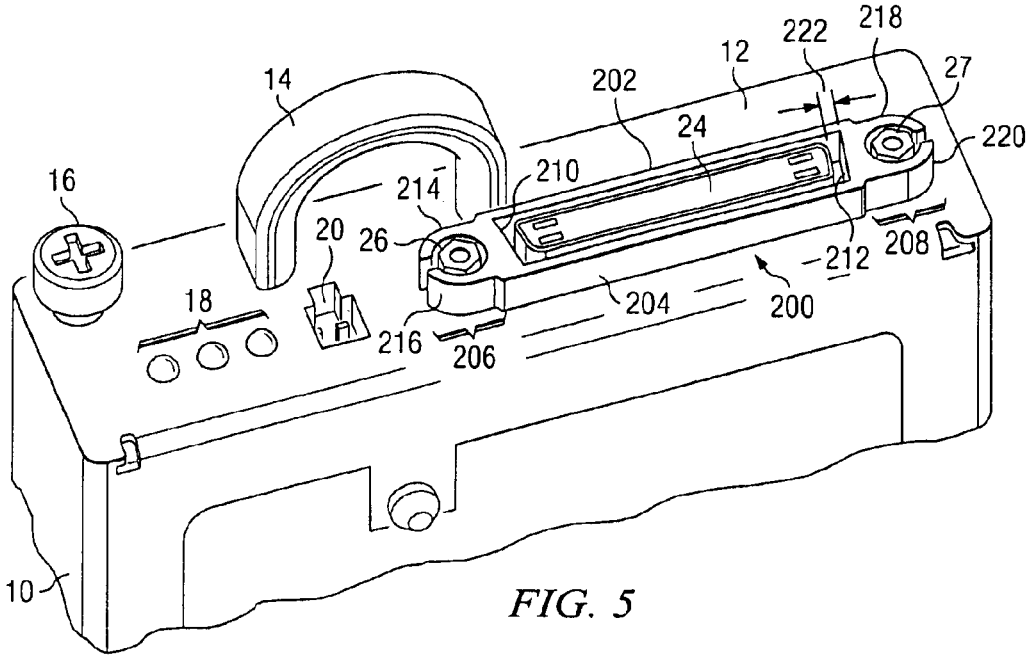
FIG. 5 is a perspective view of a chassis body of an information handling system with a D-style connector and a connector guide according to teachings of the present disclosure.

Now referring to FIG. 5, a perspective view of chassis body 10 having back plate 12 is shown similarly to FIGS. 1 and 3. Back plate 12 has an opening formed therein (not expressly shown) allowing D-style connector 24 to extend therethrough. D-style connector 24 also includes connector body 42 having a trapezoidal shape. In the present preferred embodiment connector guide 200 is installed around D-style connector 24 to facilitate the proper orientation and alignment of mating connectors to D-style connector 24. The connector guide 200 has an opening formed therein that allows connector guide 200 to be disposed around D-style connector 24. Connector guide 200 includes upper member 202 and lower member 204 connected by first end 206 and second end 208. First end 206 generally includes a first attachment portion including a first end upper arm 214 and a second end upper arm 216 that form a C shape that allows for snap fit or interference-type fit with attachment stud 26. Similarly, second end 208 includes a second attachment portion including second end upper arm 218 and a second end lower arm 220. Second end upper arm 218 and second lower arm 220 form a cup or a C shape that allows for a snap fit or interference-type fit with attachment stud 27.

Figure 6:
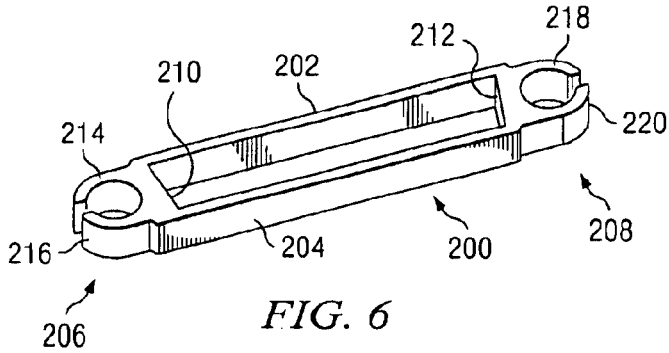
FIG. 6 is a connector guide according to teachings of the present disclosure.

Now referring to FIG. 6, connector guide 200 is shown. Connector guide 200 includes including upper member 202, lower member 204, joined by first end 206 and second end 208. First end also includes first end upper arm 214 and second end lower arm 216. Similarly second end 208 includes second end upper arm 218 and second end lower arm 220.

The connector guide includes side member 210 that is generally parallel to the first side of the connector body 42 and a second side member 212 that is generally parallel to the second side of the connector body 42. Connector guide 200 is preferably disposed such that a generally uniform gap 222 lies between the four sides of D-style connector body 42 and the four sides of connector guide 200 (upper member 202, lower member 204, first side member 210 and second side member 212). Connector guide 200 and gap 222 preferably prevents a mating connector (as shown in FIG. 2) from being attempted to be installed with an incorrect orientation or at an incorrect angle. The four sides of the connector guide (upper member 202, lower member 204, first side member 210 and second side member 212) are generally adjacent and perpendicular to the back plate 12. The overall height of the connector guide 200 is slightly greater than the height of D-style connector 24 (the distance that the connector guide extends perpendicularly from back plate 12).

In operation, connector guides according to teachings of the present invention are preferably disposed proximate D-style connector 24. Connector guide may comprise, for example, first and second alignment flanges 34 and 36, connector guide flange member 100 or connector guide body 200. In some embodiments such as that shown in FIGS. 1 and 2, the connector guide may be formed from a portion of the chassis body. As shown in FIG. 1, housing connector guide is formed from the material that is in the area from which opening 25 is formed.

In embodiments such as those shown in FIG. 3, flange member 100 may be fastened to the chassis housing 10. As shown, the first end connector tab 108 and second end connector tab 112 are aligned with attachment studs 26 and 27 which may be removed and then fastened to back plate 12 thereby securing flange member connector guide 100 to back plate 12 and proximate to D-style connector 24. In embodiments as shown in FIGS. 5 and 6, a connector guide body 200 may be snapped into place via the interference fit provided by first end upper arm 214 and first end lower arm 216, or second end upper arm 218 and second end lower arm 220.

After the connector guide is disposed proximate D-style connector 24, a mating connector 60 is then aligned with D-style connector 24. The connector guide insures that mating connector 60 is maintained at a proper orientation and alignment to interface with D-style connector 24. Note that the present disclosure also contemplates alternate embodiments (not expressly shown) in which connector guide is disposed proximate mating connector body 62, instead of being proximate D-style connector 24.

Although the disclosed embodiments have been described in detail, it should be understood that various changes, substitutions and alterations can be made to the embodiments without departing from their spirit and scope.

What is claimed is:

1. An information handling system comprising:

a chassis body for storing information handling system components;

the chassis body having at least one D-style connector extending from the chassis body, the D-style connector comprising a trapezoidal connector body; and a connector guide disposed proximate the at least one D-style connector forming a generally uniform gap between the connector guide and the trapezoidal connector body operable to facilitate the proper orientation and alignment of a mating connector during installation thereof.

2. The information handling system of claim 1 wherein the D-style connector comprises a SCSI connector.

3. The information handling system of claim 2 wherein the D-style connector comprises a 68 pin connector.

4. The information handling system of claim 1 wherein:

the chassis body comprising a back plate having a sheet metal construction, the back plate having an opening formed therein, the opening having a top edge, a bottom edge, a first side edge, and a second side edge;

the connector guide comprising a first alignment flange extending from the first side edge and a second alignment flange extending from the second side edge.

5. The information handling system of claim 4 further comprising the first alignment flange and the second alignment flange, each having a length greater than the width of the D-style connector and each alignment flange extending beyond the face of the connector.

6. The information handling system of claim 1 wherein the connector guide comprises a flange member.

7. The information handling system of claim 6 further comprising:

a first attachment stud proximate a first end of the D-style connector and a second attachment stud proximate a second end of the D-style connector; and the flange selectively fastened to the first attachment stud and the second attachment stud.

8. The information handling system of claim 6 wherein:

the flange element further comprises a longitudinal flange member having a first end and a second end;

the first end comprising a first end flange member extending from the longitudinal member and a first end connector tab extending generally perpendicular from the first end flange member in a direction away from the D-style connector; and the second end comprising a second end flange member extending from the longitudinal member and a second end connector tab extending generally perpendicular from the second end flange member in a direction away from the D-style connector.

9. The information handling system of claim 1 wherein the connector guide further comprises:

a connector guide body having an opening formed therein, the opening formed to allow the D-style connector to extend therethrough; and the connector guide body further comprising a first end and a second end each having an attachment portion formed thereon.

10. The information handling system of claim 9 further comprising:

studs proximate the connector body; and the attachment portion of the first end and second operable to with the studs, thereby securing the connector guide proximate the D-style connector.

11. The information handling system of claim 9 further comprising the attachment portions operable to attach to the studs via an interference-fit type attachment.

12. The information handling system of claim 9 further comprising the connector guide body formed from a plastic material.

13. A connector guide for preventing information handling system connector pin damage comprising:

a connector guide body having an opening formed therein, the opening formed to allow a D-style connector-to extend therethrough forming a generally uniform gap between the connector guide body and a connector body of the D-style connector; and the connector guide body further comprising a first end and a second end each having an attachment portion formed thereon, the attachment portions operable to interface with a first stud and a second stud disposed proximate the D-style connector.

14. The connector guide of claim 13 further comprising the attachment portion of the first end and second end each comprising an upper arm and a lower arm forming a C-shape attachment portion.

15. The connector guide of claim 13 further comprising the connector guide formed from a plastic material.

16. A method for preventing connector pin damage comprising:

providing a D-style connector associated with an information handling system; and disposing a connector guide proximate a D-style connector, the connector guide forming a generally uniform gap between the connector guide and a D-style connector body of the D-style connector operable to prevent an inverted mating connector from interfacing with the D-style connector.

17. The method of claim 16 further comprising forming the connector guide for portions of a chassis back plate.

18. The method of claim 16 further comprising forming a connector guide having a longitudinal flange member, a first end flange member, and a second end flange member.

19. The method of claim 16 further comprising:

forming the connector guide with an aperture therethrough and a first end and a second end each having an attachment portion; and attaching the connector guide to studs disposed adjacent the D-style connector.

* * * * *